US008277258B1

(12) United States Patent
Huang et al.

(10) Patent No.: US 8,277,258 B1
(45) Date of Patent: Oct. 2, 2012

(54) ELECTRICAL CONNECTOR

(75) Inventors: Guang-Li Huang, New Taipei (TW); Li-Jun Xu, New Taipei (TW)

(73) Assignee: Cheng Uei Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 13/046,692

(22) Filed: Mar. 11, 2011

(51) Int. Cl.
*H01R 24/00* (2006.01)

(52) U.S. Cl. ..... 439/660; 439/497

(58) Field of Classification Search ..... 439/660, 439/497

See application file for complete search history.

(56) References Cited

U.S. PATENT DOCUMENTS

| | | | | | |
|---|---|---|---|---|---|
| 4,975,069 | A * | 12/1990 | Fedder et al. | ..... | 439/101 |
| 5,052,951 | A * | 10/1991 | Johnson | ..... | 439/723 |
| 5,295,843 | A * | 3/1994 | Davis et al. | ..... | 439/108 |
| 6,027,376 | A * | 2/2000 | Matsuura et al. | ..... | 439/638 |
| 6,926,562 | B1 * | 8/2005 | Wu | ..... | 439/660 |
| 7,717,717 | B1 * | 5/2010 | Lai | ..... | 439/66 |

* cited by examiner

*Primary Examiner* — Gary F. Paumen
(74) *Attorney, Agent, or Firm* — Lin & Associates IP, Inc.

(57) ABSTRACT

An electrical connector includes an insulating housing, and a plurality of electrical contacts assembled in the insulating housing respectively. At least two of the electrical contacts having the same transmitting action are short connected together in the process of manufacturing the electrical contacts. So the process of utilizing a wire to achieve a short connection between the corresponding electrical contacts, as described in the prior art, is omitted, and it saves a lot of manpower and material resources, and further simplifies the process for achieving the short connection effect.

6 Claims, 3 Drawing Sheets

ELECTRICAL CONNECTOR

BACKGROUND OF THE INVENTION

1. Field of the Invention

The present invention relates to an electrical connector, and more particularly to an electrical connector capable of realizing a short connection between corresponding electrical contacts thereof.

2. The Related Art

It is necessary to utilize a printed circuit board to realize an electrical connection among electronic components. Generally, when two circuits on the printed circuit board need be short connected with each other, some corresponding actions are introduced to the printed circuit board. If the actions introduced to the printed circuit board can not achieve the needed short connection effect, another method introduced to realize the short connection between the two circuits is to utilize a wire to connect corresponding electrical contacts of an electrical connector electrically connected with the printed circuit board. However, when the electrical contacts are short connected by the wire, it will be achieved by manual operation. Moreover, some processes, such as soldering two ends of the wire with the corresponding electrical contacts and cutting off the wire etc., are accordingly needed. With the development of electronic technology, the electrical contact has a smaller and smaller shape and a shorter distance is accordingly between two adjacent electrical contacts. It makes the process in the foregoing method more complicated.

SUMMARY OF THE INVENTION

It is an object of the present invention to provide an electrical connector. The electrical connector includes an insulating housing, and a plurality of electrical contacts of which at least two having the same transmitting action are short connected together in the process of manufacturing the electrical contacts. The electrical contacts are assembled in the insulating housing respectively.

As described above, the electrical connector of the present invention makes the electrical contacts, which have the same transmitting action, short connected together in the process of manufacturing the electrical contacts. So the process of utilizing a wire to achieve a short connection between the corresponding electrical contacts, as described in the prior art, is omitted, so that it saves a lot of manpower and material resources, and further simplifies the process for achieving the short connection effect.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
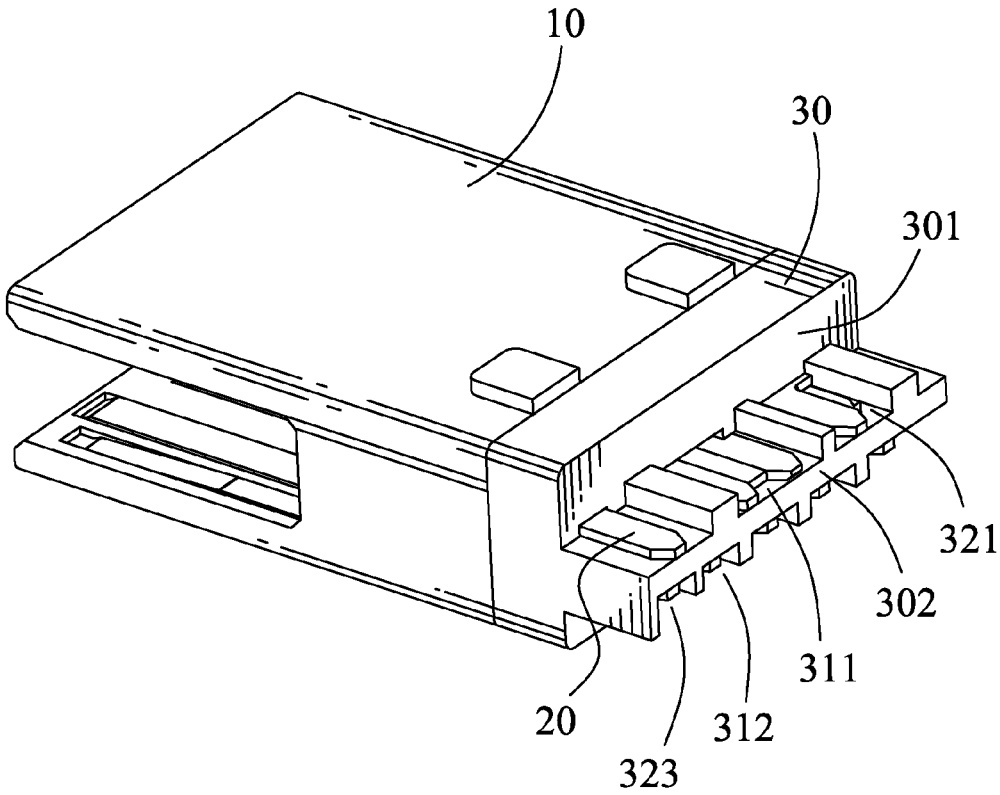
FIG. 1 is an assembled perspective view of an electrical connector according to an embodiment of the present invention.

Referring to FIG. 1, an electrical connector according to an embodiment of the present invention includes an insulating housing 10, a plurality of electrical contacts 20 of which at least two are short connected together, and a rear cover 30. The electrical contacts 20 are assembled in the insulating housing 10 and further project rearward beyond a rear surface of the insulating housing 10. The rear cover 30 is fastened behind the insulating housing 10 for positioning and propping the electrical contacts 20.

Figure 3:
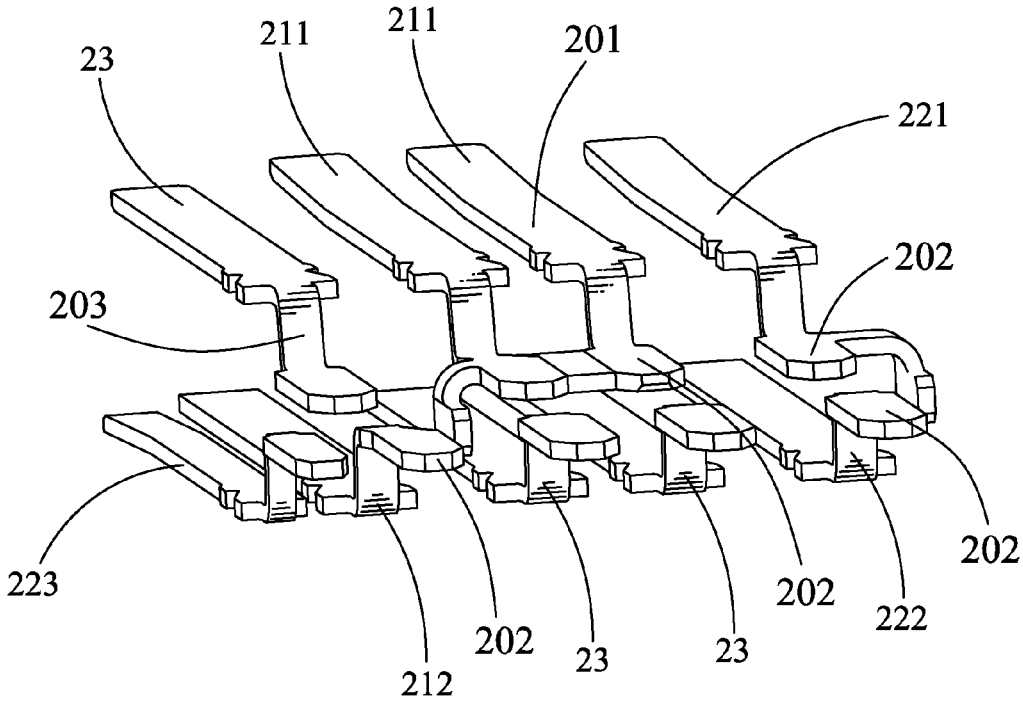
FIG. 3 is a perspective view showing a plurality of electrical contacts of the electrical connector of FIG. 1.

Referring to FIG. 1 and FIG. 3, in this embodiment, the electrical connector is an I/O connector. The electrical contacts 20 include two top ground contacts 211, a bottom ground contact 212, a top power-supply contact 221 capable of achieving a 12V voltage of power supply therethrough, a first bottom power-supply contact 222 capable of achieving a 12V voltage of power supply therethrough, a second bottom power-supply contact 223 capable of achieving a 5V voltage of power supply therethrough, and three signal contacts 23. Each of the electrical contacts 20 has a contact portion 201 and a soldering tail 202 connected with the contact portion 201 in a step manner by a connecting portion 203. The electrical contacts 20 are disposed in the insulating housing 10 with the soldering tails 202 projecting rearward beyond the rear surface of the insulating housing 10. The top ground contacts 211 are arranged side by side and spaced from each other, with the soldering tails 202 thereof further extending towards each other to be short connected with each other. The soldering tail 202 of one of the top ground contacts 211 has a side edge thereof further extending downward to make the soldering tails 202 of the one top ground contact 211 and the bottom ground contact 212 shorted connected with each other in a step manner. Moreover, the soldering tail 202 of the top power-supply contact 221 has a side edge thereof extending sideward and then bent downward to be short connected with the soldering tail 202 of the first bottom power-supply contact 222 in a step manner.

Figure 2:
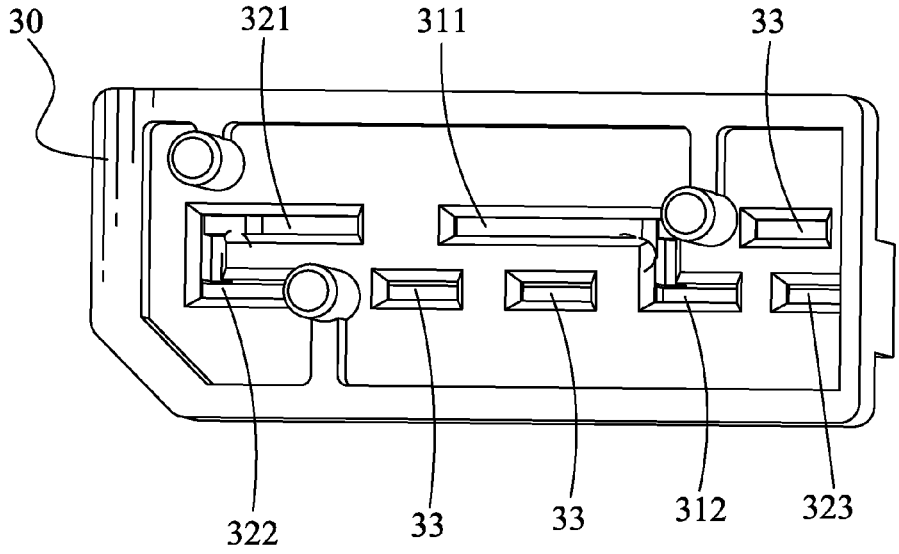
FIG. 2 is a perspective view of a rear cover of the electrical connector of FIG. 1.

Referring to FIG. 1 and FIG. 2, the rear cover 30 has a resisting portion 301 and a support portion 302 protruding rearward from a middle of a rear of the resisting portion 301. A front of the resisting portion 301 defines a plurality of positioning slots arranged into two rows adjacent to a top face and a bottom face of the support portion 302, and each penetrating rearward through the resisting portion 301 to be further exposed to the top or bottom face of the support portion 302. In the embodiment, the positioning slots include a top-ground-contact positioning slot 311 and a bottom-ground-contact positioning slot 312 which are respectively exposed to the top face and the bottom face of the support portion 302 and connected with each other in a step manner, a top-power-supply-contact positioning slot 321 and a first bottom-power-supply-contact positioning slot 322 which are respectively exposed to the top face and the bottom face of the support portion 302 and connected with each other in a step manner, a second bottom-power-supply-contact positioning slot 323 exposed to the bottom face of the support portion 302, and three signal-contact positioning slots 33.

The rear cover 30 is fastened behind the insulating housing 10 with the resisting portion 301 abutting against the rear surface of the insulating housing 10 to resist the electrical contacts 20 from moving rearward. The short-connected soldering tails 202 of the top ground contacts 211 and the bottom ground contact 212 are respectively inserted and positioned in the top-ground-contact positioning slot 311 and the bottom-ground-contact positioning slot 312 connected with each other. The short-connected soldering tails 202 of the top power-supply contact 221 and the first bottom power-supply contact 222 are respectively inserted and positioned in the top-power-supply-contact positioning slot 321 and the first bottom-power-supply-contact positioning slot 322 connected with each other. The soldering tail 202 of the second bottom power-supply contact 223 is inserted and positioned in the second bottom-power-supply-contact positioning slot 323. Other soldering tails 202 of the signal contacts 23 are inserted and positioned in the signal-contact positioning slots 33 respectively.

As described above, the electrical connector of the present invention makes the electrical contacts 20, which have the same transmitting action, short connected together in the process of manufacturing the electrical contacts 20. For example, the top ground contacts 211 and the bottom ground contact 212 have the soldering tails 202 thereof short connected with one another, and the top power-supply contact 221 and the first bottom power-supply contact 222 both capable of achieving the 12V voltage of power supply therethrough have the soldering tails 202 thereof short connected with each other. So the process of utilizing a wire to achieve a short connection between the corresponding electrical contacts, as described in the prior art, is omitted, so that it saves a lot of manpower and material resources, and further simplifies the process for achieving the short connection effect.

Figure 4:
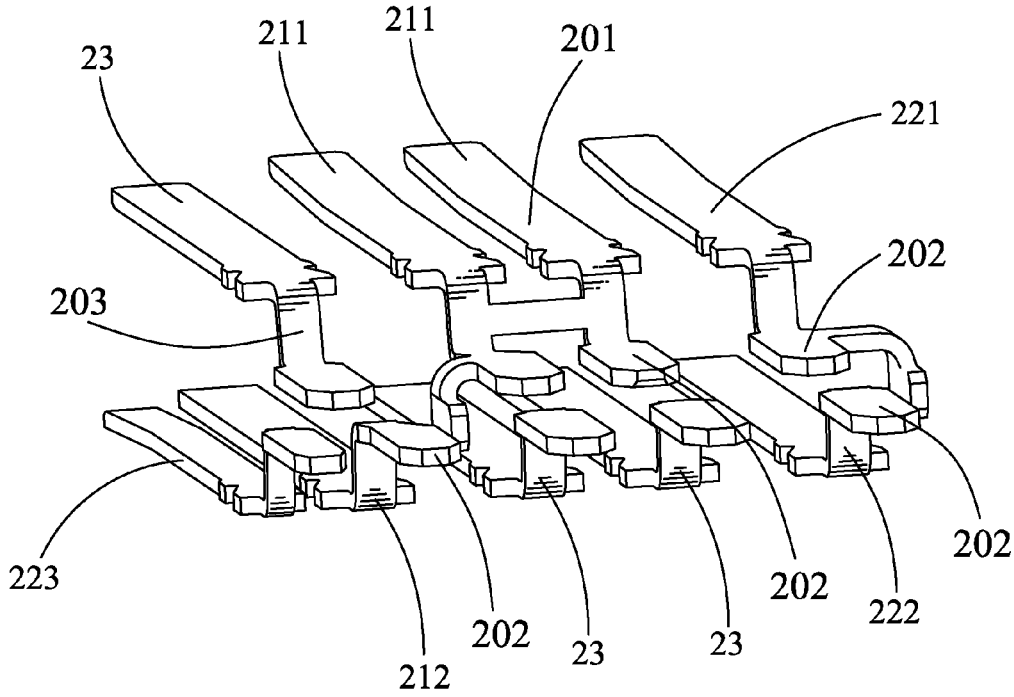
FIG. 4 is a perspective view showing that the connecting portions of the electrical contacts are shorted together.

The foregoing description of the present invention has been presented for purposes of illustration and description. It is not intended to be exhaustive or to limit the invention to the precise form disclosed, and obviously many modifications and variations are possible in light of the above teaching. For example, the rear cover 30 for positioning the electrical contacts 20 may be molded together with the insulating housing 10, and the electrical contacts 20 having the same transmitting action may realize the short connection thereamong by short connecting other portions such as the connecting portions 203 as illustrated in FIG. 4. Such modifications and variations that may be apparent to those skilled in the art are intended to be included within the scope of this invention as defined by the accompanying claims.

What is claimed is:

1. An electrical connector, comprising:

an insulating housing;

a plurality of electrical contacts of which at least two having the same transmitting action being short connected together in the process of manufacturing the electrical contacts, the electrical contacts being assembled in the insulating housing respectively, each of the electrical contacts having a contact portion and a soldering tail;

a rear cover fastened behind the insulating housing, the soldering tails projecting rearward beyond a rear of the insulating housing, the rear cover defining a plurality of positioning slots of which at least two are connected together for positioning and propping the short-connected soldering tails of the electrical contacts therein.

2. The electrical connector as claimed in claim 1, wherein the at least two electrical contacts having the same transmitting action realize the short connection thereamong by means of making the soldering tails thereof short connected together.

3. The electrical connector as claimed in claim 1, wherein the rear cover has a resisting portion abutting against the rear of the insulating housing and a support portion protruding rearward from a rear of the resisting portion, each of the positioning slots penetrates through the resisting portion and the support portion along a front-to-rear direction, the positioning slots are exposed to two opposite faces of the support portion.

4. The electrical connector as claimed in claim 1, wherein each of the electrical contacts has a contact portion and a soldering tail connected with the contact portion in a step manner by a connecting portion, the at least two electrical contacts having the same transmitting action realize the short connection thereamong by means of making the connecting portions thereof short connected together.

5. An electrical connector, comprising:

an insulating housing; and a plurality of electrical contacts of which at least two having the same transmitting action being short connected together in the process of manufacturing the electrical contacts, the electrical contacts being assembled in the insulating housing respectively;

wherein the electrical contacts include two top ground contacts and a bottom ground contact which are short connected with one another, a top power-supply contact and a first bottom power-supply contact both capable of achieving a 12V voltage of power supply therethrough which are short connected with each other, a second bottom power-supply contact capable of achieving a 5V voltage of power supply therethrough, and three signal contacts.

6. The electrical connector as claimed in claim 5, wherein each of the electrical contacts has a soldering tail, the top ground contacts are arranged side by side in the insulating housing and spaced from each other, with the soldering tails thereof extending towards each other to be short connected with each other, the soldering tail of one of the top ground contacts has a side edge thereof further extending downward to make the soldering tails of the one top ground contact and the bottom ground contact short connected with each other in a step manner, and the soldering tail of the top power-supply contact has a side edge thereof extending sideward and then bent downward to be short connected with the soldering tail of the first bottom power-supply contact in a step manner.

* * * * *